US006312545B1

(12) United States Patent
Nickel et al.

(10) Patent No.: US 6,312,545 B1
(45) Date of Patent: Nov. 6, 2001

(54) METHOD FOR PRODUCING A SPUNBONDED FABRIC FROM THERMOBONDED CRIMPED BICOMPONENT FIBERS

(75) Inventors: Axel Nickel, Peine; Stefan Etzold, Langenhagen, both of (DE)

(73) Assignee: Corovin GmbH, Peine (DE)

( * ) Notice: Subject to any disclaimer, the term of this patent is extended or adjusted under 35 U.S.C. 154(b) by 0 days.

(21) Appl. No.: 09/269,556

(22) PCT Filed: Jul. 21, 1998

(86) PCT No.: PCT/DE98/02083

§ 371 Date: Mar. 30, 1999

§ 102(e) Date: Mar. 30, 1999

(87) PCT Pub. No.: WO99/06621

PCT Pub. Date: Feb. 11, 1999

(30) Foreign Application Priority Data

Aug. 1, 1997 (DE) ..... 197 33 493

(51) Int. Cl.[7] ..... D04H 1/54; D04H 3/00; D04H 3/16

(52) U.S. Cl. ..... 156/229; 156/290; 156/309.3; 428/297.4; 264/168; 442/382

(58) Field of Search ..... 156/229, 166, 156/290, 309.3; 428/297.4; 264/168; 442/381, 382

(56) References Cited

U.S. PATENT DOCUMENTS

| | | | | |
|---|---|---|---|---|
| 5,102,724 | | 4/1992 | Okawahara et al. . | |
| 5,108,820 | * | 4/1992 | Kaneko et al. | 428/198 |
| 5,382,400 | | 1/1995 | Pike et al. . | |
| 5,662,978 | * | 9/1997 | Brown et al. | 428/57 |
| 5,789,328 | * | 8/1998 | Kurihara et al. | 442/387 |
| 5,804,517 | * | 9/1998 | Ishii et al. | 442/361 |

FOREIGN PATENT DOCUMENTS

| | | |
|---|---|---|
| 0168225A2 | 1/1986 | (EP) . |
| 0391260A1 | 10/1990 | (EP) . |
| 0481092A1 | 4/1992 | (EP) . |
| 0586924A1 | 3/1994 | (EP) . |
| 02191757 | 7/1990 | (JP) . |
| 04327257 | 11/1992 | (JP) . |
| 05125645 | 5/1993 | (JP) . |

* cited by examiner

*Primary Examiner*—Richard Crispino
*Assistant Examiner*—Sue A. Purvis
(74) *Attorney, Agent, or Firm*—Burns, Doane, Swecker & Mathis, L.L.P.

(57) ABSTRACT

A process is disclosed for the manufacture of a spunbonded fabric consisting of thermobonded curled bicomponent fibers where the bicomponent fibers consist of two plastic materials with different properties. The process according to the invention consists of three steps: the fibers spun from the two plastic materials are drawn off uncurled and stretched in a first step. In a second step the fibers are placed on a sieve belt and thermobonded. In a third step the bicomponent fibers of the obtained nonwoven fabric are finally curled by lengthwise and/or transverse stretching and heat treatment.

5 Claims, 2 Drawing Sheets

Figure 1:
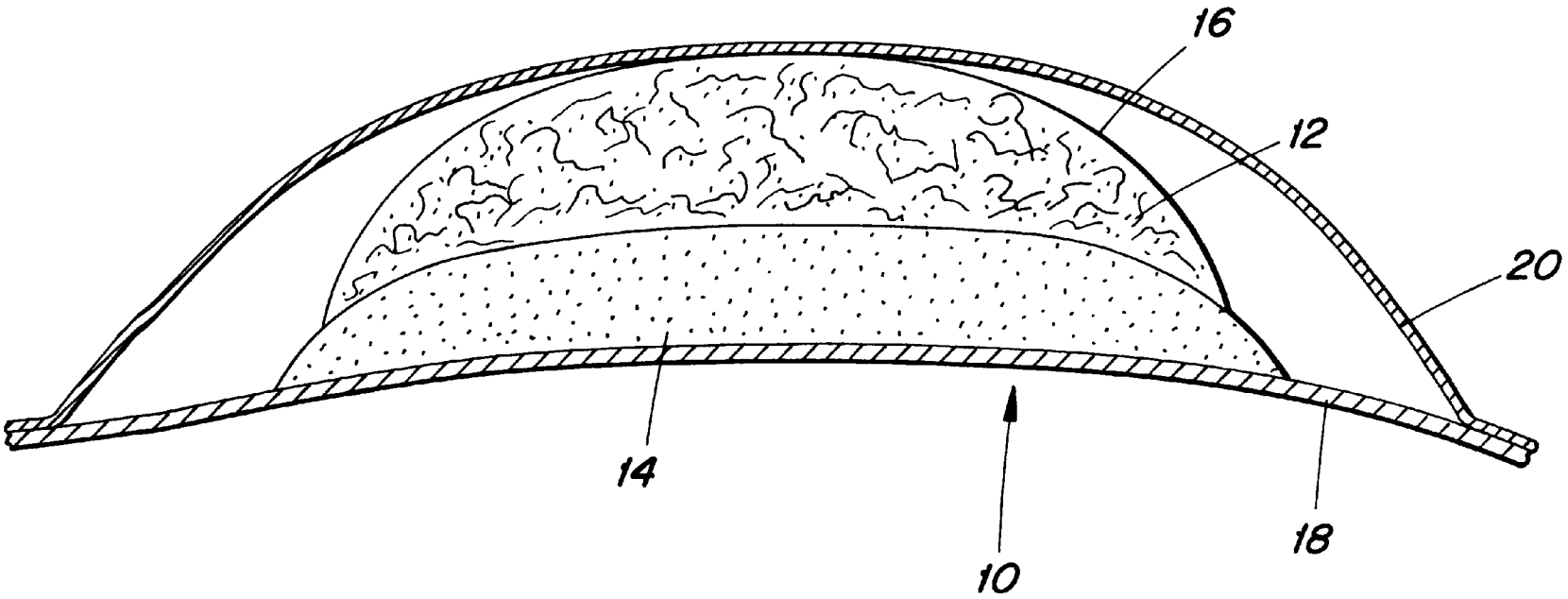

METHOD FOR PRODUCING A SPUNBONDED FABRIC FROM THERMOBONDED CRIMPED BICOMPONENT FIBERS

The invention concerns a process for the manufacture of a spunbonded fabric of thermobonded curled bicomponent fibers, whereby the bicomponent fibers consist of two plastic materials with different properties.

Such a process is disclosed in EP 0 391 260 A1 where composite fibers placed on a screen belt are curled and adhere to each other through the effect of heat, i.e. heated air. In this process, cold air is blown from below through the sieve belt shortly before hot air is supplied to fluff the nonwoven fabric. Such a nonwoven fabric is up to about 2.3 mm thick. Nonwovens created by such processes can be used in hygienic products such as diapers or sanitary napkins as an acquisition layer. For some applications these nonwovens are too thin or have too hard a feel and are also not voluminous enough. A similar process is also disclosed in U.S. Pat. No. 5,382,400.

Common to these and other processes is the fact that the filaments are curled solely by the treatment with heat. Thermobonding also occurs while treating the filaments with heat, i.e. the individual fibers are adhered at their bonding points. The nonwoven fabric obtained in this manner does not satisfy all requirements, especially when used for hygienic products, in particular they are frequently insufficiently voluminous.

The problem of the invention is to present a process of the initially mentioned type that can create spunbonded fabrics from thermobonded curled bicomponent fibers that are voluminous, and that can specifically influence the properties of the nonwoven fabric with regard to strength, porosity, curling of the individual fibers and final weight. If needed, the watertightness of the nonwovens created by the process is to be influenced by the process.

This problem is solved by a process with the features of Patent claim 1.

In the invention process to manufacture spunbonded fabrics of thermobonded, curled bicomponent fibers where the bicomponent fibers consist of two plastic materials with different properties, the fibers spun from the two plastic materials are drawn off uncurled and stretched in a first step, placed on a sieve belt and thermobonded in a second step, and the bicomponent fibers of the nonwoven fabric formed in this manner are stretched lengthwise and/or transversely and curled by heat treatment in a third step.

It was surprisingly shown that the properties of the nonwoven fabric could be directly influenced when the nonwoven fabric is stretched lengthwise and transversely during heat treatment. The actual curling of the bicomponent fibers in the invention process is obtained during relaxing following lengthwise and/or transverse stretching. The rate of curling can be increased by the combined thermal and mechanical influences on the fibers in the spunbonded fabric whereby the nonwoven fabric obtained in this way becomes more voluminous than the nonwoven fabrics obtained with prior art processes. With nonwoven fabrics created by conventional processes, part of the curling and hence part of the volume is lost during thermobonding and other heat treatments.

It was found to be advantageous to curl the nonwoven fabric by mechanical stretching only after thermobonding, thereby increasing the volume of the nonwoven fabrics obtained in this way compared with those obtained by conventional processes.

A larger volume is particularly advantageous when the nonwoven fabric made by the process according to the invention is used as an acquisition layer in diapers and sanitary napkins.

In one advantageous embodiment of the process, the latter is carried out with bicomponent fibers of the side-by-side type. In another embodiment of the invention the process is carried out with bicomponent fibers with an eccentric core. By using solid or hollow bicomponent fibers of the side-by-side type and the type with an eccentric core, a softer product feel can be obtained. This soft feel allows all nonwoven fabrics previously used for hygiene to be replaced.

Another embodiment of the invention provides that the process be carried out with segmented hollow bicomponent fibers where neighboring segments of each fiber consist of different materials. In another embodiment the fibers of the nonwoven fabric are stretched and heat-treated such that the fibers curl and fibrillate. In this, use was made of the knowledge that the stretching especially of segmented bicomponent fibers beyond a certain degree of stretching will result in fibrillation, i.e. a controlled tearing open or splitting open occurs. When the fibers stretched and fibrillated in this way are relaxed again, they are curled in addition to fibrillation.

A nonwoven fabric obtained in this manner possesses the same basis weight yet clearly lower porosity which makes the nonwoven fabric more watertight.

In one advantageous embodiment of the invention the fibers are spun from two polypropylene granulates. The MFI viscosity range of the first polypropylene granulate is 16 to 35 and the MFI viscosity range of the second polypropylene granulate is 8 to 10 points below the MFI viscosity range of the first polypropylene granulate.

Alternatively, the fibers can be spun from two different polyolefins, or a polyolefin and PET.

Figure 2:
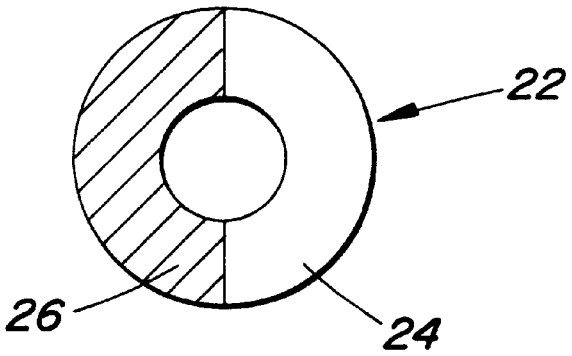
Figure 3:
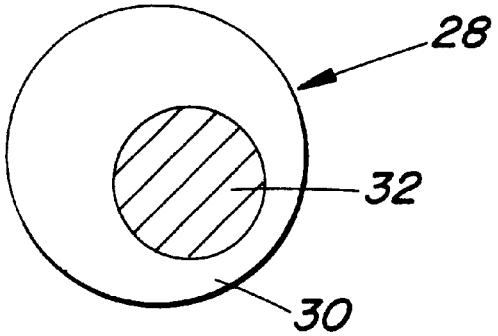
Figure 4:
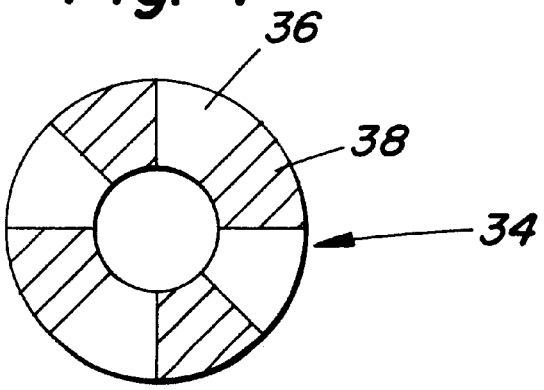

The invention will now be further explained with reference to the drawing, the description and patent claims. Shown in the drawings are:

FIG. 1: a cross-section of a diaper with an acquisition layer manufactured using a process according to the invention, FIG. 2: a cross-section of a bicomponent fiber of the side-by-side type, FIG. 3: a cross-section of a bicomponent fiber with an eccentric core, and FIG. 4: a cross-section of a segmented hollow bicomponent fiber.

FIG. 1 shows an exemplary embodiment in the form of a diaper 10 that uses a spunbonded fabric 12 created by the process according to the invention. To create the spunbonded fabric 12 a hollow fiber 22 of the side-by-side type shown in FIG. 2 is spun with equipment known per se. The hollow side-by-side fiber 22 consist of two halves of a cylinder envelope 24 and 26 of plastic materials with different properties. Accordingly, the cylinder envelope half 24 consists of polypropylene with an MFI viscosity range of 16 to 35, whereas the cylinder envelope half 26 consists of polypropylene whose MFI viscosity range is 8 to 10 points below that of the polypropylene of cylinder envelope half 24.

Numerous hollow fibers 22 obtained in this way are drawn off in such a manner that stretching them does not produce any curling yet. Then the hollow fibers 22 are placed on a sieve belt with equipment known per se and thermobonded. In a subsequent step, the spunbonded fabric 12 created after thermobonding is stretched in a device familiar from film manufacturing both in the direction of the machine and transversely. During this stretching process and the subsequent relaxation, curling and hence fluffing of the nonwoven fabric 12 occurs in the individual hollow fibers 22 due to various stretching properties of the cylinder envelope halves 24 and 26. It is particularly important for the nonwoven fabric to be simultaneously heat-treated.

The nonwoven fabric 12 obtained in this manner can now be used in the diaper 10 as an acquisition layer 16 placed over a core 14. This acquisition layer 16 serves to spatially separate the core 14 absorbing the body fluid from the cover layer 20 contacting the organism. This means that the acquisition layer 16 serves to prevent fluid that has collected in the core 14 from recontacting the body surface of an organism to be treated since the cover layer 20 must generally be kept very porous so that it cannot be designed as a semi-permeable structure. Finally, the fluid stored in the core 14 is prevented from leaving by a film 18 joined to the cover layer 20.

A spunbonded fabric manufactured according to the process of the invention can be used as the material for the cover layer 20 for the manufacture of which bicomponent fibers 28 with a casing 30 and an eccentric core 32 shown in FIG. 3 are used. A spunbonded fabric manufactured with such fibers 28 is suitable for use as a cover layer 20 since it has a soft feel and is comfortable to the skin.

If a spunbonded fabric manufactured by the process of the invention is supposed to have sound waterproof properties, the fibers 34 portrayed in FIG. 4 are used to manufacture such. The cross-section of the fibers 34 shown in FIG. 4 consists of individual segments 36 and 38. Neighboring segments 36, 38 are made of different raw materials such as polypropylene with different MFI viscosity ranges, polyolefins such as PP and PE in different phases, or a combination of PET with a polyolefin. When the fibers 34 are stretched they fibrillate; i.e. the fibers 34 split along the abutting surfaces of the segments 36, 38. This fibrillation of the fiber 34 clearly lowers the porosity while the basis weight of the nonwoven fabric remains the same resulting in an increased watertightness of the nonwoven fabric. This makes it possible to use a nonwoven fabric manufactured in this manner as a cover material for the diaper 10 or for similar hygienic products.

What is claimed is:

1. A process for the manufacture of a spunbonded fabric from thermobonded curled bicomponent fibers consisting of two plastic materials having different properties, said process comprising the following steps:

(a) drawing off the bicomponent fibers melt spun from the two plastic materials uncurled and stretching the bicomponent fibers, (b) placing the bicomponent fibers on a sieve belt and thermobonding the bicomponent fibers to obtain a nonwoven fabric, (c) stretching the bicomponent fibers of the nonwoven fabric lengthwise and/or transversely and heating the bicomponent fibers during the stretching, and thereafter (d) relaxing the bicomponent fibers of the nonwoven fabric to obtain the spunbonded fabric with curled bicomponent fibers, wherein the bicomponent fibers in step (a) are spun from two polypropylene granulates with a first polypropylene granulate having an MFI viscosity range of 16 to 35 and a second polypropylene granulate having an MFI viscosity range which is 8 to 10 points below the MFI viscosity range of the first polypropylene granluate.

2. A process for the manufacture of a spunbonded fabric from thermobonded curled bicomponent fibers consisting of two plastic materials having different properties, said process comprising the following steps:

(a) drawing off the bicomponent fibers melt spun from the two plastic materials uncurled and stretching the bicomponent fibers, wherein the bicomponent fibers are of a side-by-side type, (b) placing the bicomponent fibers on a sieve belt and thermobonding the bicomponent fibers to obtain a nonwoven fabric, (c) stretching the bicomponent fibers of the nonwoven fabric lengthwise and/or transversely and heating the bicomponent fibers during the stretching, and thereafter (d) relaxing the bicomponent fibers of the nonwoven fabric to obtain the spunbonded fabric with curled bicomponent fibers, wherein the bicomponent fibers in step (a) are spun from two polypropylene granulates with a first polypropylene granulate having an MFI viscosity range of 16 to 35 and a second polypropylene granulate having an MFI viscosity range which is 8 to 10 points below the MFI viscosity range of the first polypropylene granulate.

3. A process for the manufacture of a spunbonded fabric from thermobonded curled bicomponent fibers consisting of two plastic materials having different properties, said process comprising the following steps:

(a) drawing off the bicomponent fibers melt spun from the two plastic materials uncurled and stretching the bicomponent fibers, wherein the bicomponent fibers have an eccentric core, (b) placing the bicomponent fibers on a sieve belt and thermobonding the bicomponent fibers to obtain a nonwoven fabric, (c) stretching the bicomponent fibers of the nonwoven fabric lengthwise and/or transversely and heating the bicomponent fibers during the stretching, and thereafter (d) relaxing the bicomponent fibers of the nonwoven fabric to obtain the spunbonded fabric with curled bicomponent fibers, wherein the bicomponent fibers in step (a) are spun from two polypropylene granulates with a first polypropylene granulate having an MFI viscosity range of 16 to 35 and a second polypropylene granulate having an MFI viscosity range which is 8 to 10 points below the MFI viscosity range of the first polypropylene granulate.

4. A process for the manufacture of a spunbonded fabric from thermobonded curled bicomponent fibers consisting of two plastic materials having different properties, said process comprising the following steps:

(a) drawing off the bicomponent fibers melt spun from the two plastic materials uncurled and stretching the bicomponent fibers, wherein the bicomponent fibers are segmented and hollow with neighboring segments of each fiber consisting of different materials, (b) placing the bicomponent fibers on a sieve belt and thermobonding the bicomponent fibers to obtain a nonwoven fabric, (c) stretching the bicomponent fibers of the nonwoven fabric lengthwise and/or transversely and heating the bicomponent fibers during the stretching, and thereafter (d) relaxing the bicomponent fibers of the nonwoven fabric to obtain the spunbonded fabric with curled bicomponent fibers, wherein the bicomponent fibers in step (a) are spun from two polypropylene granulates with a first polypropylene granulate having an MFI viscosity range of 16 to 35 and a second polypropylene granulate having an MFI viscosity range which is 8 to 10 points below the MFI viscosity range of the first polypropylene granulate.

5. A process for the manufacture of a spunbonded fabric from thermobonded curled bicomponent fibers consisting of two plastic materials having different properties, said process comprising the following steps:

(a) drawing off the bicomponent fibers melt spun from the two plastic materials uncurled and stretching the bicomponent fibers, wherein the bicomponent fibers are segmented and hollow with neighboring segments of each fiber consisting of different materials, (b) placing the bicomponent fibers on a sieve belt and thermobonding the bicomponent fibers to obtain a nonwoven fabric, (c) stretching the bicomponent fibers of the nonwoven fabric lengthwise and/or transversely and heating the bicomponent fibers during the stretching, and thereafter (d) relaxing the bicomponent fibers of the nonwoven fabric to obtain the spunbonded fabric with curled bicomponent fibers, wherein the bicomponent fibers in step (a) are spun from two polypropylene granulates with a first polypropylene granulate having an MFI viscosity range of 16 to 35 and a second polypropylene granulate having an MFI viscosity range which is 8 to 10 points below the MFI viscosity range of the first polypropylene granulate, and wherein the bicomponent fibers of the nonwoven fabric are fibrillated in step (c) and curled in step (d).

* * * * *